US009397447B2

(12) United States Patent
Kurachi

(10) Patent No.: US 9,397,447 B2
(45) Date of Patent: Jul. 19, 2016

(54) ELECTRICAL CONNECTOR AND ELECTRICAL CONNECTOR DEVICE

(71) Applicant: Dai-Ichi Seiko Co., Ltd., Kyoto-shi (JP)

(72) Inventor: Takaki Kurachi, Ogori (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 0 days.

(21) Appl. No.: 14/859,509

(22) Filed: Sep. 21, 2015

(65) Prior Publication Data

US 2016/0104971 A1 Apr. 14, 2016

(30) Foreign Application Priority Data

Oct. 10, 2014 (JP) ..... 2014-208761

(51) Int. Cl.

| | |
|---|---|
| ***H01R 13/62*** | (2006.01) |
| ***H01R 13/652*** | (2006.01) |
| ***H01R 13/04*** | (2006.01) |
| ***H01R 13/639*** | (2006.01) |

(52) U.S. Cl.

CPC ..... *H01R 13/652* (2013.01); *H01R 13/04* (2013.01); *H01R 13/639* (2013.01)

(58) Field of Classification Search

CPC ..... H01R 13/62933; H01R 13/62938
USPC ..... 439/372, 607.27, 108, 607.4
See application file for complete search history.

(56) References Cited

U.S. PATENT DOCUMENTS

| | | | | |
|---|---|---|---|---|
| 8,388,370 | B2 * | 3/2013 | Yamaji | H01R 13/62994 439/497 |
| 8,602,812 | B2 * | 12/2013 | Ohsaka | H01R 12/775 439/497 |
| 8,727,803 | B2 * | 5/2014 | Kurachi | H01R 12/88 439/497 |
| 9,190,776 | B2 * | 11/2015 | Lee | H01R 13/639 |
| 2012/0132518 | A1 * | 5/2012 | Miller | H01J 37/3408 204/192.13 |

FOREIGN PATENT DOCUMENTS

| | | |
|---|---|---|
| JP | 2007-073426 | 3/2007 |
| JP | 2011-238410 | 11/2011 |

* cited by examiner

*Primary Examiner* — Phuong Dinh
(74) *Attorney, Agent, or Firm* — Oblon, McClelland, Maier & Neustadt, L.L.P

(57) ABSTRACT

To allow easy and reliable establishment of electromagnetic shielding regarding a portion connected to a circuit board with a simple structure, a shield plate provided to a fit-in holding member which keeps a state of fitting in a counterpart connector externally covers board connection legs of counterpart contact members and, simultaneously with an operation of rotating the fit-in holding member when connectors fit together, electromagnetic shielding with respect to the board connection legs is immediately established. Also, a ground connecting units provided to the fit-in holding member are connected to ground connection conductive paths provided at positions near the board connection legs of the counterpart contact members, thereby obtaining favorable electromagnetic shielding characteristics. Also, a connected state at the board connection legs can be favorably confirmed.

12 Claims, 13 Drawing Sheets

ELECTRICAL CONNECTOR AND ELECTRICAL CONNECTOR DEVICE

TECHNICAL FIELD OF THE INVENTION

The present invention relates to an electrical connector and electrical connector device configured so that a fit-in holding member is rotated when fitting in a counterpart connector to keep a state of fitting in the counterpart connector.

BACKGROUND OF THE INVENTION

In general, in various electrical devices and so forth, an electrical connector device has been widely used in order to connect a terminal portion of any of various signal transmission media formed of a flexible printed circuit (FPC), a flexible flat cable (FFC), a coaxial cable, or the like, to a printed circuit board. The electrical connector device is configured so that, for example, a first connector (receptacle connector) to be implemented on a printed circuit board and a second connector (plug connector) to which a signal transmission medium such as a coaxial cable is coupled fit together so that the second connector is inserted into the first connector. Signal transmission is performed through conductive contact members (conductive terminals) arranged so as to form multipolarity inside a connector main body unit.

In this electrical connector device, a structure has been conventionally often adopted in which, in order to reduce an influence of external electromagnetic noise on a transmission signal or reduce electromagnetic noise emitted toward the outside, an outer surface of the connector main body unit (insulating housing) and/or an outer side of the contact members is covered with a conductive shell or a shield plate formed of a thin-plate metal member, thereby establishing electromagnetic shielding.

However, particularly in recent years, with higher frequency of a transmission signal being achieved, it is required to eliminate an influence of external electromagnetic noise from not only a main portion of the contact members (conductive terminals) but also a portion connected to the circuit board and also reliably prevent external emission of electromagnetic noise from a portion connected to the contact members.

In a conventional electrical connector device, conductive tape is affixed to a portion connecting the contact members and the circuit board, or a conductive shell is extended to cover the connecting portion. However, when conductive tape is used, a relatively burdensome work process of affixing the conductive tape is added, and therefore productivity tends to decrease. Also, for example, the conductive shell of the first connector (receptacle connector) is extended to cover, the portion connecting the contact members and the circuit board may not be able to be confirmed visually, by image inspection, or the like, thereby disadvantageously making it difficult to examine or confirm whether a work of connecting the contact members or the like is being performed without hindrance.

We disclose Japanese Unexamined Patent Application Publication Nos. 2007-73426 and 2011-238410 as examples of related art.

SUMMARY OF THE INVENTION

Thus, an object of the present invention is to provide an electrical connector and electrical connector device with a simple structure allowing easy and reliable establishment of electromagnetic shielding regarding a portion connected to a circuit board.

To achieve the above object, one aspect of the preset invention provides an electrical connector for use as fitting in a counterpart connector implemented on a front surface of a circuit board, with a terminal portion of a signal transmission medium coupled to the connector main body unit, the electrical connector configured so that a contact member mounted on the connector main body unit is connected to the signal transmission medium, a board connection leg of a counterpart contact member mounted on the counterpart connector is connected to the circuit board, and the contact member makes contact with the counterpart contact member when fitting in the counterpart connector to establish electrical connection, and a fit-in holding member rotatably provided to the connector main body unit is rotated from a fit-in release position to a fit-in operation position when fitting in the counterpart connector to keep a state of the fitting in the counterpart connector. The electrical connector adopts a structure in which the fit-in holding member is provided with a shield plate which covers at least the board connection leg of the counterpart contact member when the fit-in holding member is rotated to the fit-in operation position, a ground connecting unit provided to the fit-in holding member makes contact with the ground connection conductive path of the circuit board when the fit-in holding member is rotated to the fit-in operation position, and the ground connecting unit of the fit-in holding member is integrally and contiguously formed on the shield plate.

Another aspect of the present invention provides an electrical connector device including a first connector to which a terminal portion of a signal transmission medium is to be coupled and a second connector in which the first connector fits as the second connector is implemented on a front surface of a circuit board, a first contact member mounted on the first connector being connected to the signal transmission medium, a board connection leg of a second contact member mounted on the second connector being connected to the circuit board, and the first contact member making contact with the second contact member when the first and second connectors fit together to establish electrical connection, and a fit-in holding member rotatably provided to the first connector being rotated from a fit-in release position to a fit-in operation position when fitting in the second connector to keep a state of the fitting in the second connector. The electrical connector device adopts a structure in which the fit-in holding member of the first connector is provided with a shield plate which covers at least a board connection leg of the second contact member when the fit-in holding member is rotated to the fit-in operation position, a ground connection conductive path is formed at a position near a portion on the front surface of the circuit board and where the board connection leg of the second contact member is to be connected, a ground connecting unit provided to the fit-in holding member makes contact with the ground connection conductive path of the circuit board when the fit-in holding member is rotated to the fit-in operation position, and the ground connecting unit of the fit-in holding member is integrally and contiguously formed on the shield plate.

According to these aspects of the present invention with the above-described structures, by rotating the fit-in holding member from the fit-in release position to the fit-in operation position after the connectors fit together, the shield plate provided to the fit-in holding member externally covers the board connection leg of the counterpart contact member or the second contact member. Therefore, simultaneously with the operation of rotating the fit-in holding member when the connectors fit together, electromagnetic shieling with respect to the portion connected to the circuit board is immediately established. Also, the ground connecting unit of the fit-in holding member is connected to the ground connection conductive path disposed near the board connection leg of the counterpart contact member or the second contact member, and ground connection is made at a position near the portion to be subjected to electromagnetic shielding. Therefore, favorable electromagnetic shielding characteristics can be obtained. Furthermore, the portion connected to the circuit board is not covered with the shield plate of the fit-in holding member until the fit-in holding member is rotated to the fit-in operation position. Therefore, the connected state at the connected portion can be favorably confirmed.

Here, as in still another aspect of the present invention, the ground connecting unit provided to the fit-in holding member is preferably fixed by mechanical coupling means to the circuit board. Furthermore, as in still another aspect of the present invention, the ground connecting unit preferably includes a plurality of plate spring members which elastically make contact with the ground connection conductive path, and the mechanical coupling means is preferably disposed so as to be interposed between the plurality of plate spring members.

According to these aspects of the present invention with the above-described structures, the ground connection for establishing electromagnetic shielding is reliably and firmly made by the mechanical coupling means, thereby further improving electromagnetic shielding characteristics.

Also, as in still another aspect of the present invention, the shield plate is preferably formed so as to cover the counterpart contact member or the second contact member from outside the circuit board, and the shield plate preferably includes an upper-surface shield cover which covers the counterpart contact member or the second contact member from outside and a back-surface cover extending from the upper-surface shield cover so as to cover outside of the board connection leg. Furthermore, as in still another aspect of the present invention, a shield shell member which covers an outer surface of the counterpart connector or the second connector is preferably attached to the counterpart connector or the second connector, and the counterpart contact member or the second contact member is preferably covered with the shield shell member and the shield plate from outside of the circuit board.

According to these aspects of the present invention with the above-described structures, the counterpart contact member or the second contact member is covered from outside with the shield plate only or with both of the shield shell member and the shield plate. Therefore, electromagnetic shieling (shielding) with respect to the counterpart contact member or the second contact member can be further enhanced.

Still further, as in still another aspect of the present invention, the counterpart connector or the second connector is preferably provided with a lock unit which holds the fit-in holding member at the fit-in operation position.

According to the aspect including the above-described structure, the fit-in state of both of the connectors is favorably kept by the lock unit.

As described above, in the present invention, the shield plate is provided to the fit-in holding member which keeps a state of fitting in the counterpart connector or the second connector, and the shield plate externally covers the board connection leg of the counterpart contact member or the second contact member. Therefore, simultaneously with an operation of rotating the fit-in holding member when the connectors fit together, electromagnetic shielding with respect to the portion connected to the circuit board is immediately established. Also, the ground connecting unit provided to the fit-in holding member is connected to the ground connection conductive path provided at the position near the board connection leg of the counterpart contact member or the second contact member for ground connection at a position near a portion to be subjected to electromagnetic shielding, thereby obtaining favorable electromagnetic shielding characteristics and also allowing a connected state at the board connection legs to be favorably confirmed. Therefore, electromagnetic shielding regarding the portion connected to the circuit board can be easily and reliably established with a simple structure, and reliability of the electrical connector and the electrical connector device can be significantly enhanced with an inexpensive manner.

BRIEF DESCRIPTIONS OF THE DRAWINGS

DESCRIPTIONS OF THE PREFERRED EMBODIMENTS

An embodiment when the present invention is applied to an electrical connector and electrical connector device for connecting a plurality of coaxial cables to a printed circuit board side is described in detail below based on the drawings.

[General Outline of Entire Structure of Electrical Connector]

Figure 1:
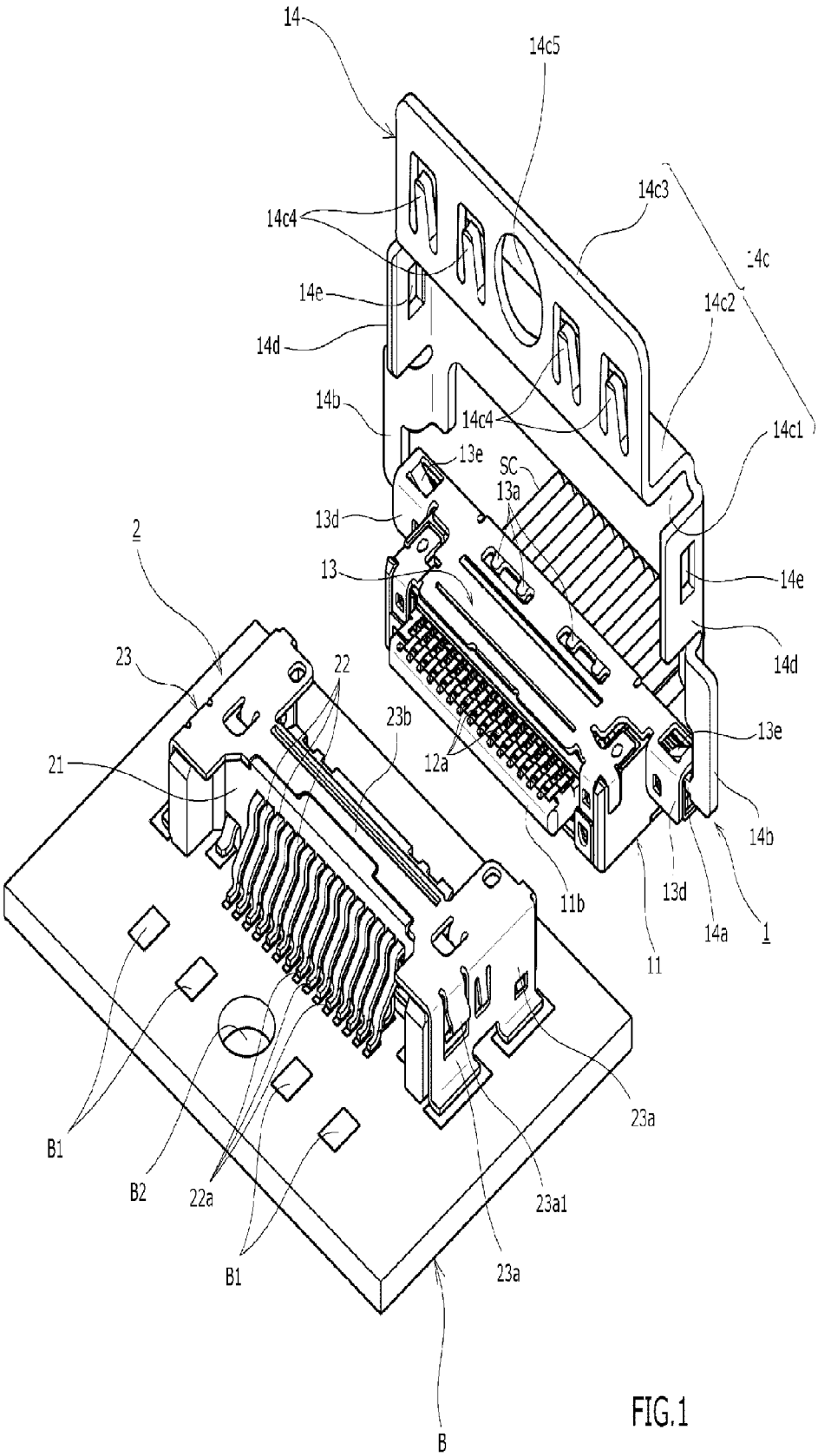
FIG. 1 is an illustrative external perspective view of an electrical connector device in a state before a plug connector (first connector) fits in a receptacle connector (second connector) as a counterpart connector, according to an embodiment of the present invention.
Figure 2:
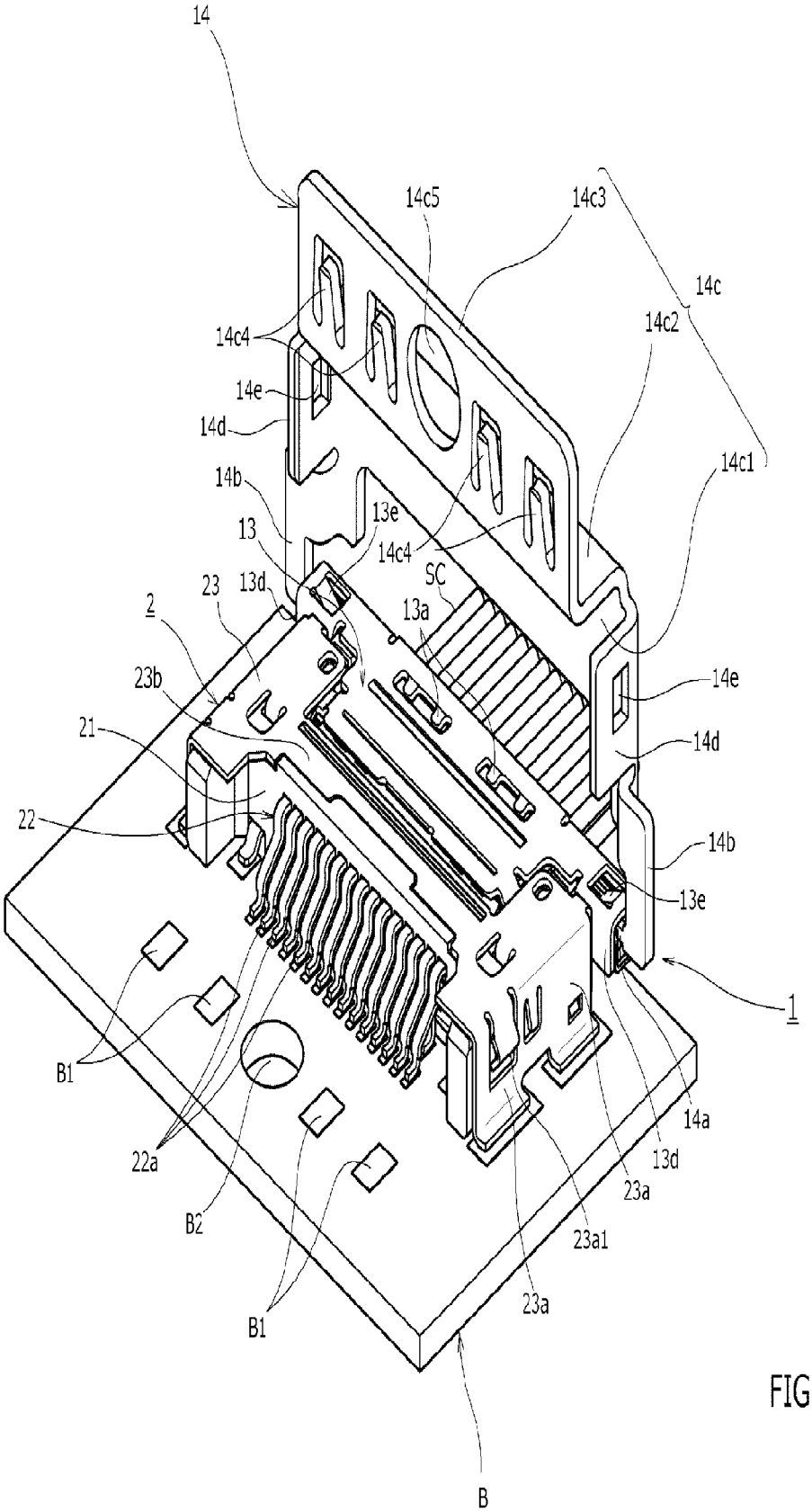
FIG. 2 is an illustrative external perspective view of the electrical connector device in a state continued from the state of FIG. 1 after the plug connector (first connector) fits in the receptacle connector (second connector)

First, an electrical connector device according to the embodiment of the present invention depicted in FIG. 1 to FIG. 13 is of a horizontal fit-in type, including a plug connector as a first connector to which terminal portions of coaxial cables SC configuring a signal transmission medium are connected, and a receptacle connector 2 as a second connector implemented on a printed circuit board B. As depicted in FIG. 1, the plug connector (first connector) 1 is disposed so as to face the receptacle connector (second connector) 2 as a fit-in counterpart connector in a substantially horizontal direction, and is then horizontally moved to be closer to the receptacle connector 2 along a front surface of the printed circuit board B. With this, as depicted in FIG. 2, a tip portion of the plug connector 1 is inserted inside the receptacle connector 2 through its opening, thereby causing the both of the connectors 1 and 2 to become in a fit-in state.

As such, in the present embodiment, the direction of inserting the plug connector (first connector) 1 into the receptacle connector (second connector) 2 and the direction of extracting in an opposite direction approximately match an extending direction of the front surface of the printed circuit board B. In the following, the extending direction of the front surface of the printed circuit board B is taken as a horizontal direction, and a direction orthogonal to the front surface of the printed circuit board B is taken as a vertical direction. Also, in the plug connector 1, the direction of inserting the plug connector 1 into the receptacle connector 2 as a counterpart connector is taken as a forward direction, and the direction of extracting in the opposite direction is taken as a backward direction. Furthermore, in the receptacle connector 2 as a counterpart connector, the direction of extracting the plug connector 1 from the receptacle connector 2 is taken as a forward direction, and its opposite direction is taken as a backward direction.

The plug connector (first connector) 1 and the receptacle connector (second connector) 2 forming the electrical connector device include insulating housings 11 and 21, respectively, each as a connector main body unit formed of an insulating member in a narrowly-elongated shape. In the insulating housing (connector main body unit) 11, a plurality of conductive contact members (conductive terminals) 12 are arranged as contact members along a longitudinal direction (vertical direction with respect to the paper sheet of FIG. 7) of the insulating housing 11 so as to form multi-polarity with appropriate pitches. In the insulating housing (connector main body unit) 21, a plurality of conductive contact members (conductive terminals) 22 are arranged as contact members along a longitudinal direction (vertical direction with respect to the paper sheet of FIG. 7) of the insulating housing 21 so as to form multi-polarity with appropriate pitches.

Of the above-described connectors 1 and 2, a rear edge portion of the plug connector (first connector) 1 has coupled thereto terminal portions of a plurality of coaxial cables SC in two upper and lower stages, the coaxial cables SC being arranged in parallel with each other along the connector longitudinal direction to form multi-polarity. The coaxial cables SC on the upper and lower stages have a relation of being arranged as shifted in position by a half pitch from each other in a direction of multipole arrangement (connector longitudinal direction).

Figure 10:
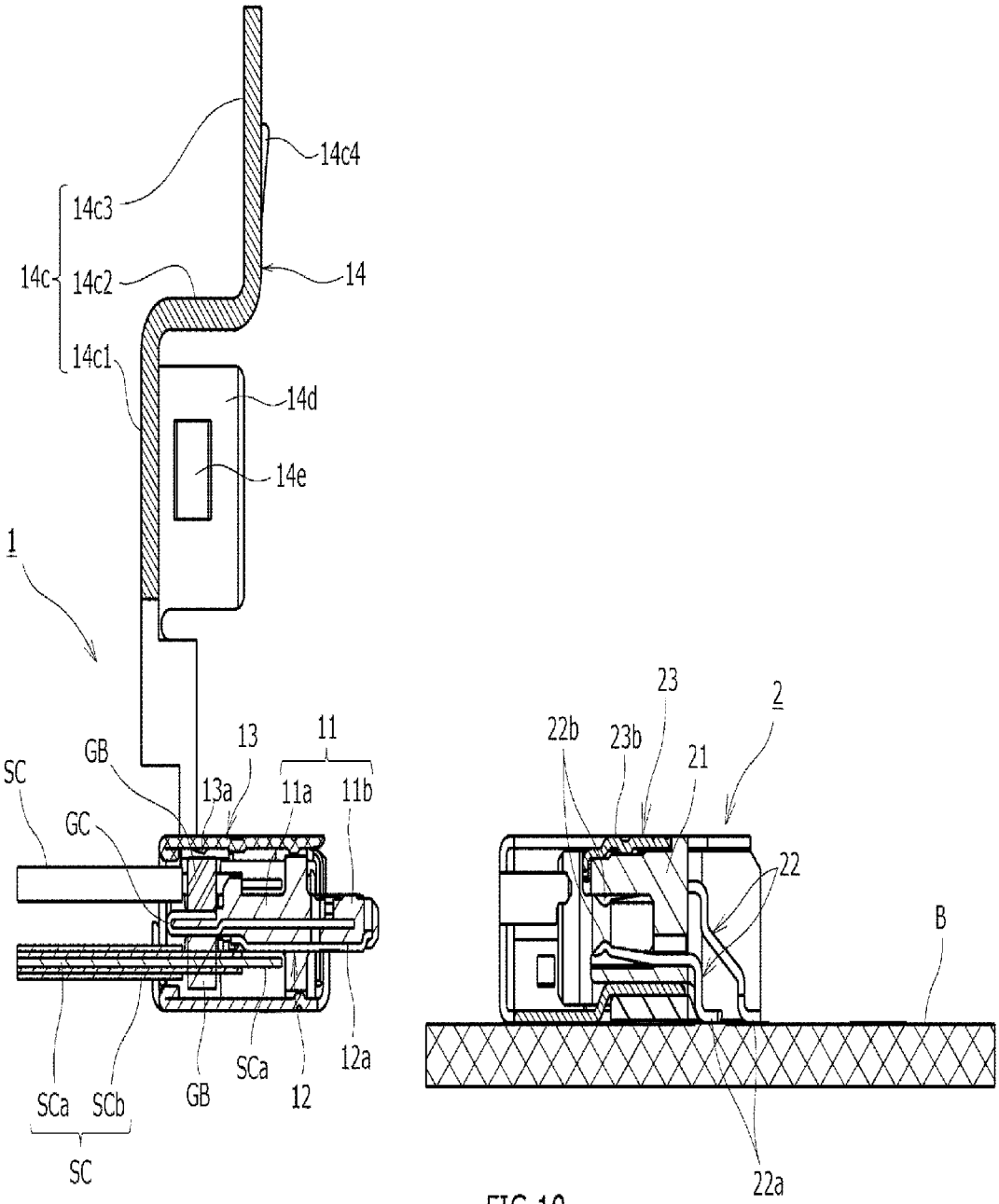
FIG. 10 is an illustrative cross-sectional view of the electric connector device in the state before both of the connectors depicted in FIG. 1 fit together, at a cross-sectional position of a coaxial cable on a lower stage side in a direction orthogonal to a connector longitudinal direction.
Figure 11:
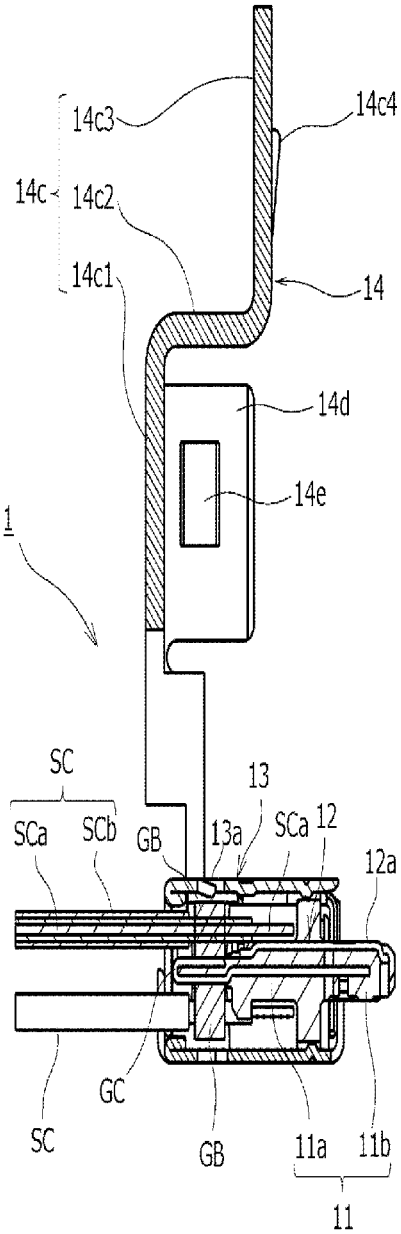
FIG. 11 is an illustrative cross-sectional view of the electric connector device in the state before both of the connectors depicted in FIG. 1 fit together, at a cross-sectional position of a coaxial cable on an upper stage side in the direction orthogonal to the connector longitudinal direction.
Figure 11:
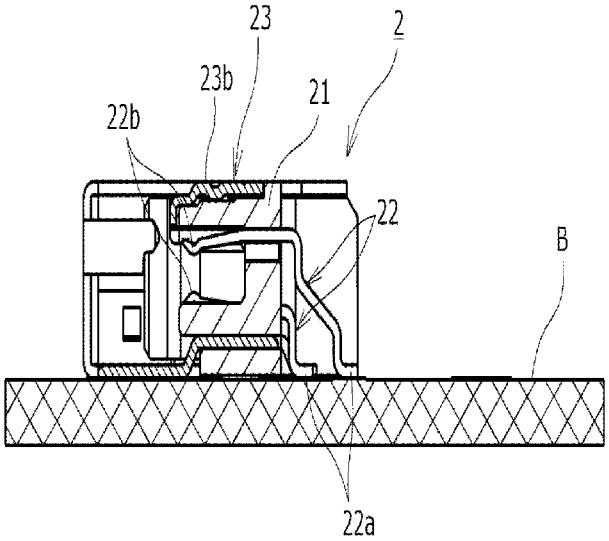
Figure 12:
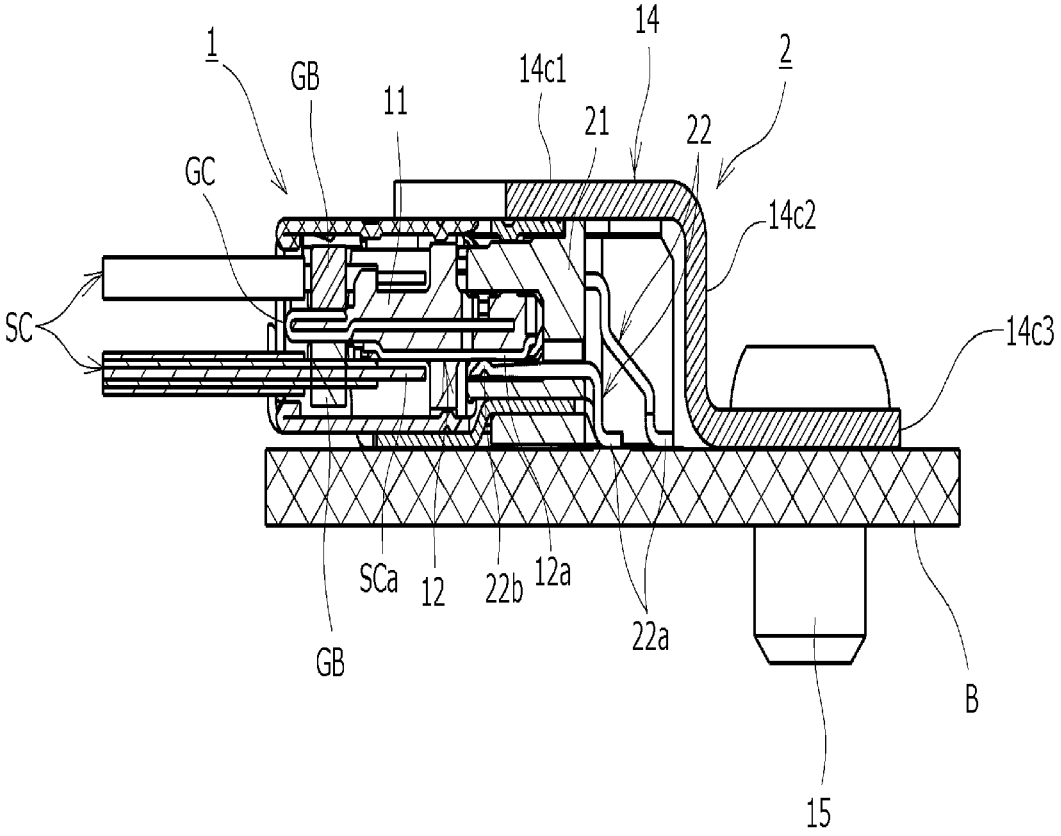
FIG. 12 is an illustrative cross-sectional diagram along a C-C line depicted in FIG. 8.
Figure 13:
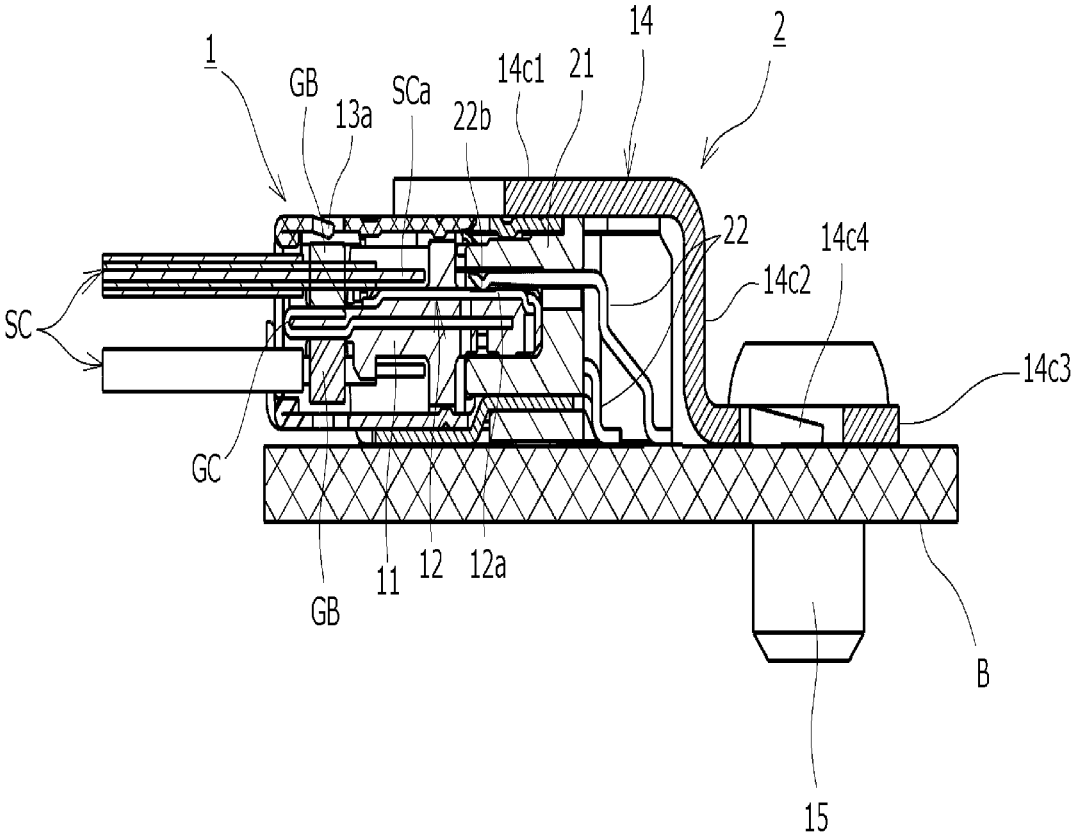
FIG. 13 is an illustrative cross-sectional diagram along a D-D line depicted in FIG. 8.

At the terminal portion of each coaxial cable SC, as depicted in FIG. 10 and FIG. 11, a coating member is stripped to cause a cable center conductor (signal line) SCa and a cable outer conductor (shield line) SCb to be coaxially exposed. The cable center conductor SCa arranged along a center axis line of the coaxial cable SC is connected to the conductive contact members (conductive terminals) 12 and 22 for signal transmission, thereby forming a signal circuit. The connection structure of the cable center conductor SCa will be described in detail further below.

The cable outer conductor SCb disposed so as to concentrically surround an outer perimeter of the above-described cable center conductor SCa is disposed, for each of the two upper and lower multipole arrangement stages, so as to penetrate through the inside of a ground bar GB forming a conductive ground member. Each of the ground bars GB on the two upper and lower stages in the present embodiment is formed of a narrowly-elongated block-shaped member extending in a long shape along the multipole arrangement direction (connector longitudinal direction) of the coaxial cables SC described above. Each ground bar GB is connected to the cable outer conductor (shield line) SCb of the coaxial cable SC by soldering, swaging, pressure welding, or the like in a collective manner. Each of the ground bars GB on the two upper and lower stages provided as described above is connected to a ground circuit formed on the printed circuit board B via a conductive shell or the like, which will be described further below.

[Insulating Housings and Conductive Contact Members]

As described above, these electrical connectors, that is, the plug connector (first connector) 1 and the receptacle connector (second connector) 2, include the narrowly-elongated insulating housings (connector main body units) 11 and 21 extending in a narrowly-elongated shape in the multipole arrangement direction (connector longitudinal direction) of the conductive contact members (conductive terminals) 12 and 22, respectively. The conductive contact members 12 and 22 mounted on the insulating housings 11 and 21, respectively, are formed so as to have different shapes correspondingly to the coaxial cables SC on the two upper and lower stages described above, and the conductive contact members 12 and 22 of two types, with those adjacent to each other in the multipole arrangement direction (connector longitudinal direction) having different shapes, are alternately arranged.

Here, the insulating housing 11 provided to the plug connector 1 is formed so as to extend in the connector longitudinal direction (multipole arrangement direction) as described above, and is configured to integrally include a main body support unit 11*a* arranged inside the plug connector 1 to form a connector main body unit and a fit-in projection 11*b* provided so as to extend from the main body support unit 11*a* toward front. Inside the insulating housing 11 from the main body support unit 11*a* over the fit-in projection 11*b*, ground contacts GC to be in contact with the ground bars GB on the two upper and lower stages described above are buried.

Furthermore, in a portion of the insulating housing 11 described above from the main body support unit 11*a* over the fit-in projection 11*b*, the conductive contact members (first contact members) 12 are buried by insert molding or press fitting as being exposed from each of upper and lower surfaces of the insulating housing 11. That is, of the conductive contact members 12 formed to have two types, those of one type are arranged as substantially horizontally extending so as to be exposed upward from an upper surface of the insulating housing 11 (refer to FIG. 11 and FIG. 13), and those of the other type are arranged as substantially horizontally extending so as to be exposed downward from a lower surface of the insulating housing 11 (refer to FIG. 10 and FIG. 12). The conductive contact members 12 of these two types are alternately arranged in the multipole arrangement direction (connector longitudinal direction).

To a rear end portion of each of the conductive contact members (first contact members) 12 provided to the plug connector (first connector) 1, the cable center conductor (signal line) SCa is connected by soldering as the conductive contact members 12 abut thereon from both above and below. Solder joint between the cable center conductors SCa and the conductive contact members 12 can be collectively performed. In this manner, the coaxial cables SC are coupled to the conductive contact members 12 of the plug connector 1.

On both upper and lower surfaces of the fit-in projection 11*b* provided at a front end of the insulating housing (connector main body unit) 11 as described above, terminal electrode units 12*a* forming a forward portion of the above-described conductive contact members (first contact members) 12 are disposed so as to form multipole exposed electrodes. When the plug connector (first connector) 1 fits in the receptacle connector (second connector) 2 as described above, the terminal electrode units 12*a* forming a forward extending portion of the conductive contact members 12 abut on the conductive contact members (second contact members) 22 provided to the receptacle connector 2 to form a signal transmission circuit. Note that these conductive contact members 12 and 22 can be configured for ground connection.

The conductive contact members (second contact members) 22 mounted on the insulating housing (connector main body unit) 21 of the receptacle connector (second connector) 2 are configured to be arranged so that those of two types corresponding to the two types of the conductive contact members (first contact members) 12 in the plug connector (first connector) 1 described above form multi-polarity. That is, of the conductive contact members 22 formed to have two types, those of one type are disposed so as to extend above the conductive contact members 12 disposed on the upper stage (refer to FIG. 11 and FIG. 13), and those of the other type are disposed so as to extend below the conductive contact members 12 disposed on the lower stage (refer to FIG. 10 and FIG. 12). The conductive contact members 22 of these two types provided to the receptacle connector 2 are configured to elastically make contact with the conductive contact members 12 of the two types in the plug connector 1 from both above and below when the electrical connectors 1 and 2 fit together.

Also, a rear end portion (a right side of FIG. 10 to FIG. 13) of each of the conductive contact members (second contact members) 22 provided to the receptacle connector (second connector) 2 is provided with a board connection leg 22*a* formed so as to extend along the surface of the printed circuit board B described above. In practical use, these board connection legs 22*a* can be collectively subjected to solder joint after being placed on a signal conduction path or a ground connection conductive path on the printed circuit board B described above.

The conductive contact members (second contact members) 22 in the present embodiment are formed so as to be folded to stand upward from the board connection legs 22*a* disposed at the rear end portion described above, and extend in a cantilever shape from an upper end portion of a standing portion toward front (a left side of FIG. 10 to FIG. 13). A front tip portion of each of the conductive contact members 22 is provided with a contact projection 22*b* projecting in a mountain shape downward on the upper multipole arrangement stage and upward on the lower multipole arrangement stage. An apex on a lower end side and an upper side of each of the contact projections 22*b* provided to the conductive contact members 22 is configured so as to elastically make contact with the terminal electrode unit 12*a* of the conductive contact member (first contact member) 12 in the plug connector 1 when the plug connector (first connector) 1 fits in the receptacle connector (second connector) 2 as described above. With this elastic contact relation, electrical connection between the terminal electrode units 12*a* and the contact projections 22*b* described above is made.

[Regarding Conductive Shells (Shield Shell Members)]

Outer surfaces of the insulating housings (connector main body units) 11 and 21 provided to the plug connector (first connector) 1 and the receptacle connector (second connector) 2 are covered with conductive shells (shield shell members) 13 and 23, respectively, each formed by folding a thin-plate metal member in an appropriate shape. These conductive shells 13 and 23 are mounted as members to provide electromagnetic shielding by covering the signal transmission circuit and the ground circuit formed inside the connectors 1 and 2, respectively, and also serve as members configuring part of the ground circuit.

Here, the conductive shell (shield shell member) 13 provided to the plug connector (first connector) 1 is configured of a fit-in body of paired shell piece members interposing the insulating housing (connector main body unit) 11 from above and below. After both of the ground bars (ground members) GB are solder-jointed to the coaxial cables SC, both of the upper-half and lower-half shell piece potions of the conductive shell 13 are attached so as to cover the insulating housing (connector main body unit) 11 from above and below. On an upper surface and a lower surface of the conductive shell 13 formed of the shell piece members, a plurality of ground connection tongues 13*a* are formed by cutting, along the connector longitudinal direction, that is, the multipole arrangement direction. Each of these ground connection tongues 12*a* is formed to stand by cutting so as to form a cantilever plate-spring shape projecting in a diagonal direction toward space inside the connector, and elastically makes contact with or solder-jointed to an upper surface side of the ground bar GB described above.

[Conductive Shell (Shield Shell Member) of Receptacle Connector]

By contrast, as depicted in FIG. 1 and FIG. 2, the conductive shell (shield shell member) 23 provided to the receptacle connector (second connector) 2 as a counterpart connector is provided with hold-down hardware pieces 23*a* at both ends in the connector longitudinal direction so as to interpose the conductive shell 23 from outside. The hold-down hardware pieces 23*a* are provided in a pair on one side in the connector longitudinal direction, with a lower edge of each hold-down hardware piece 23*a* solder-jointed to the ground connection conduction path formed on the printed circuit board B, thereby establishing an electrical connection of the ground circuit and firmly fixing the entire receptacle connector 2.

Also, both of the hold-down hardware pieces 23*a* disposed at both ends in the connector longitudinal direction as described above are integrally coupled by an upper shell plate 23*b* extending flatly along the upper surface of the insulating housing (connector main body unit) 21. The above-configured conductive shell 23 and the above-described insulating housing 21 form the connector main body unit.

[Fit-In Holding Member]

Figure 3:
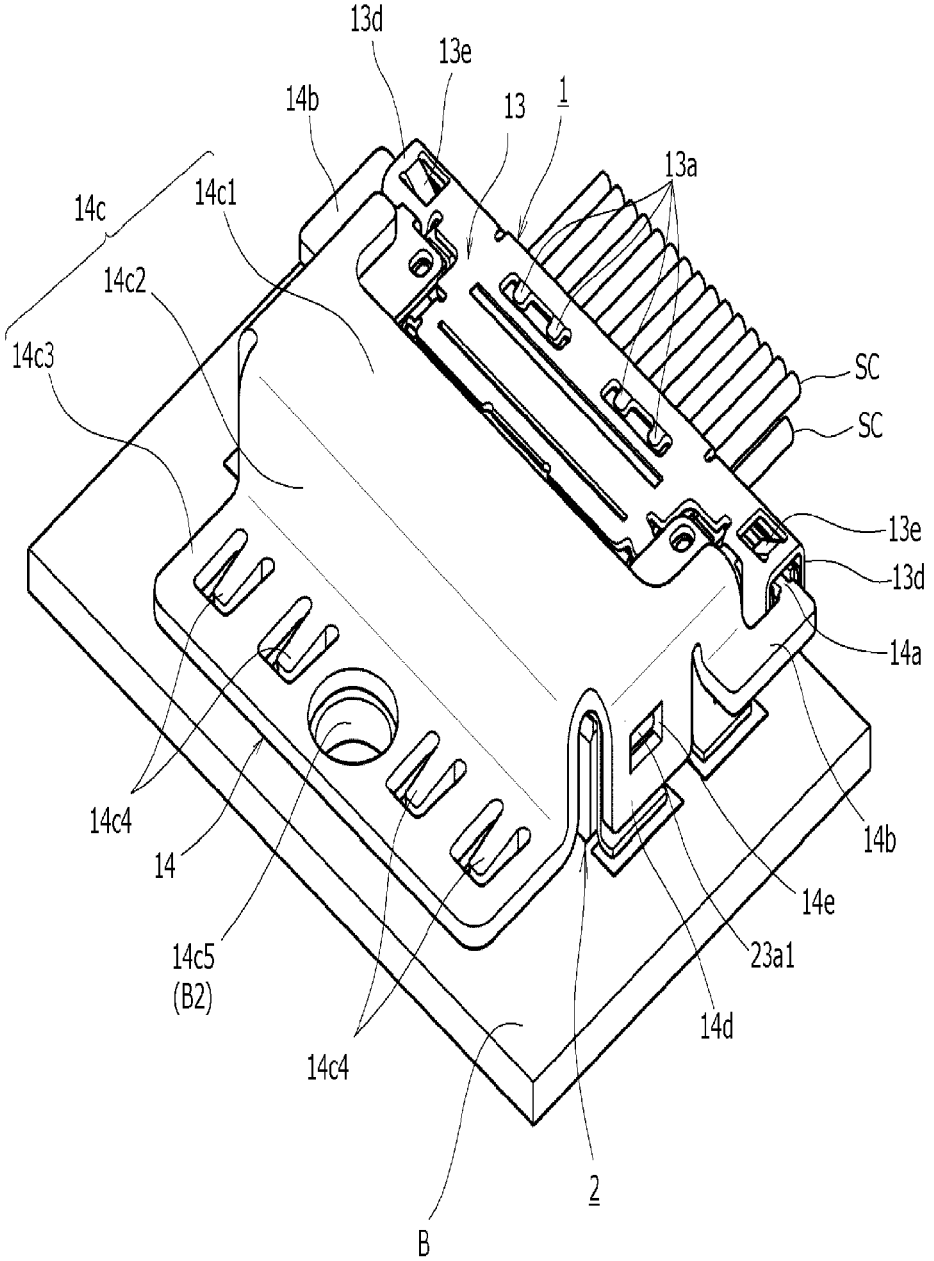
FIG. 3 is an illustrative external perspective view of the electrical connector device in a state after a fit-in holding member at a "fit-in release position" depicted in FIG. 2 is rotated to a "fit-in operation position"
Figure 4:
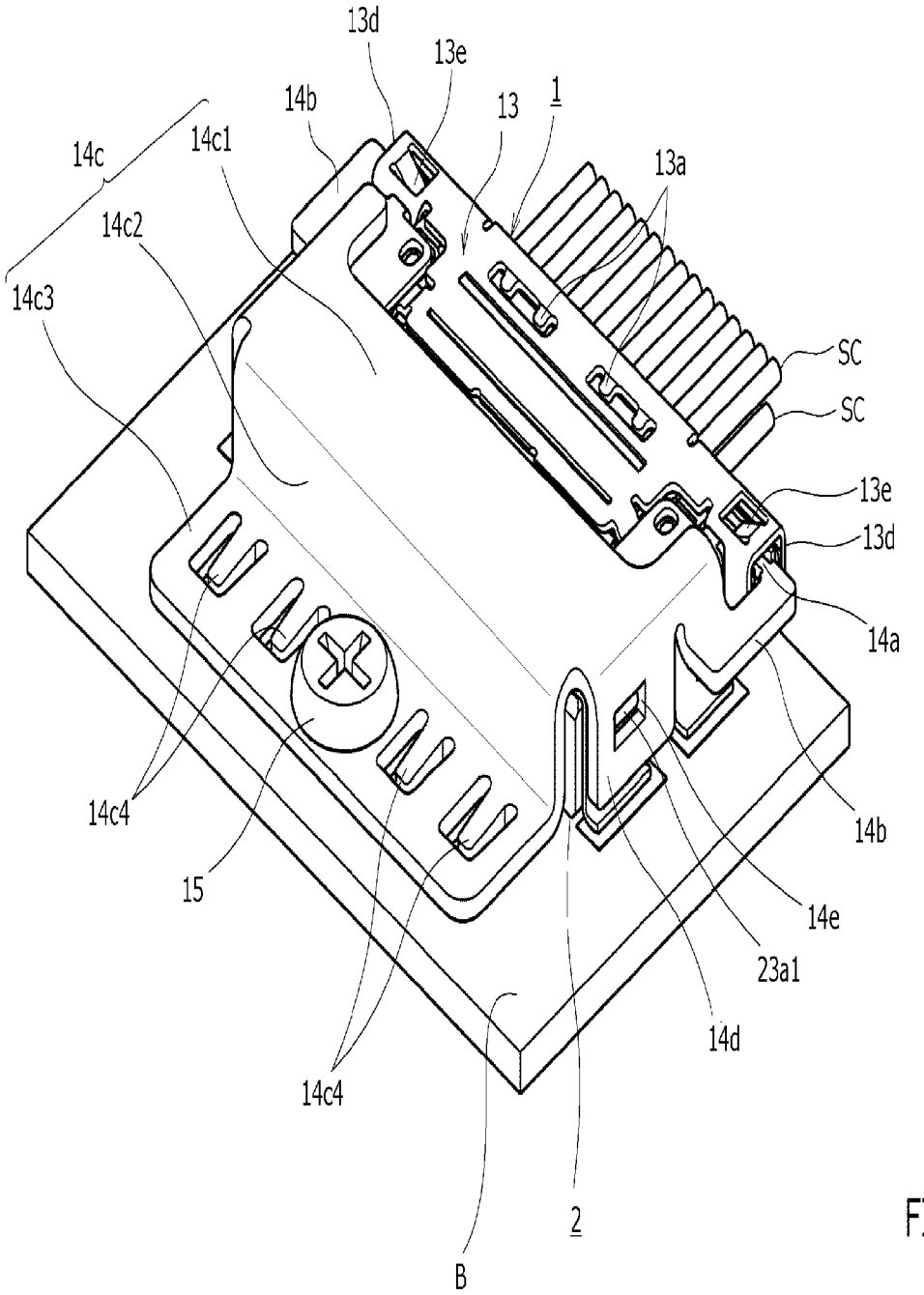
FIG. 4 is an illustrative external perspective view of a state in which the fit-in holding member at the "fit-in operation position" depicted in FIG. 3 is fastened and fixed with a fixing screw as mechanical coupling means.
Figure 5:
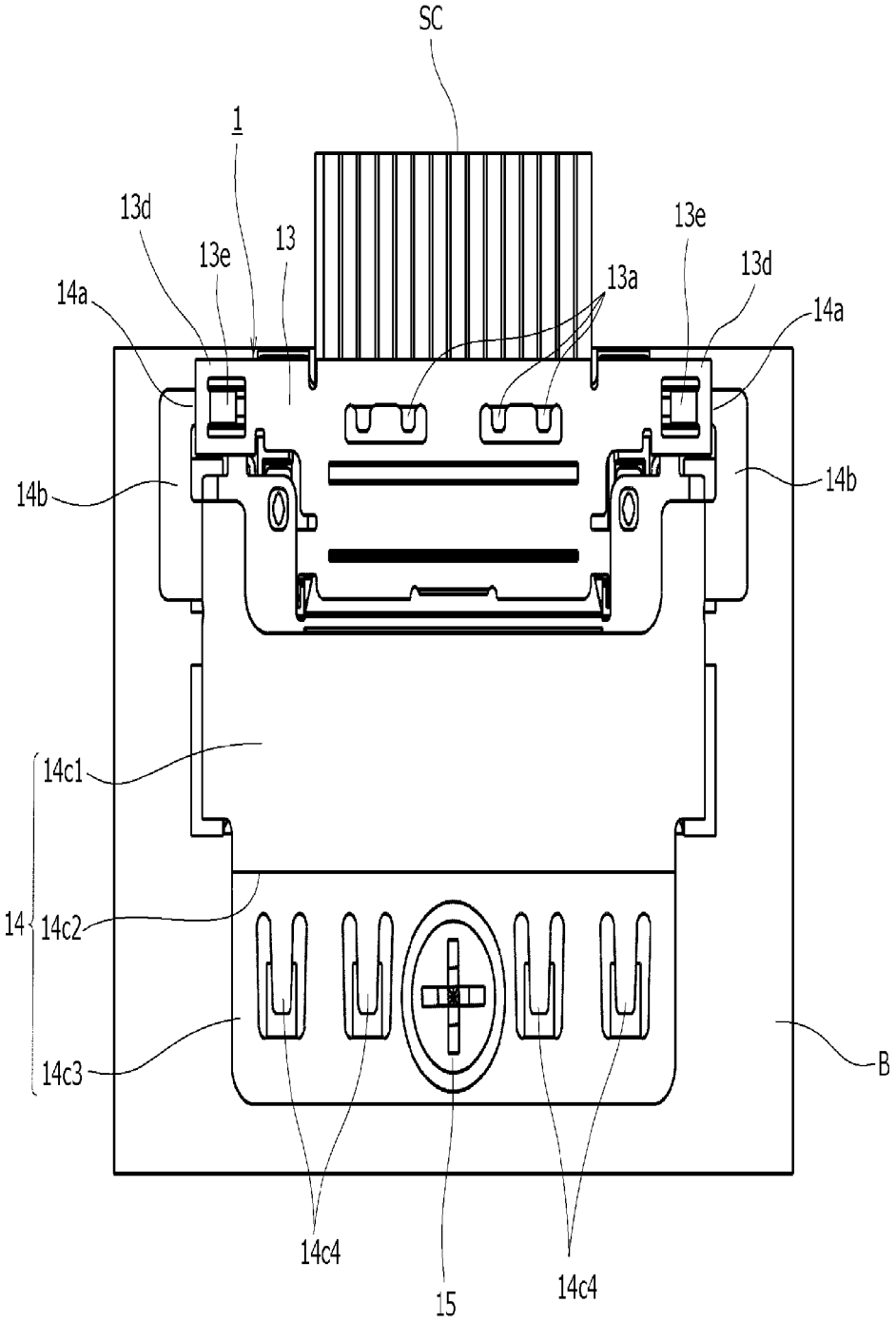
FIG. 5 is an illustrative plan view of the electrical connector device with both of the connectors of FIG. 4 being in a fit-in state.
Figure 6:
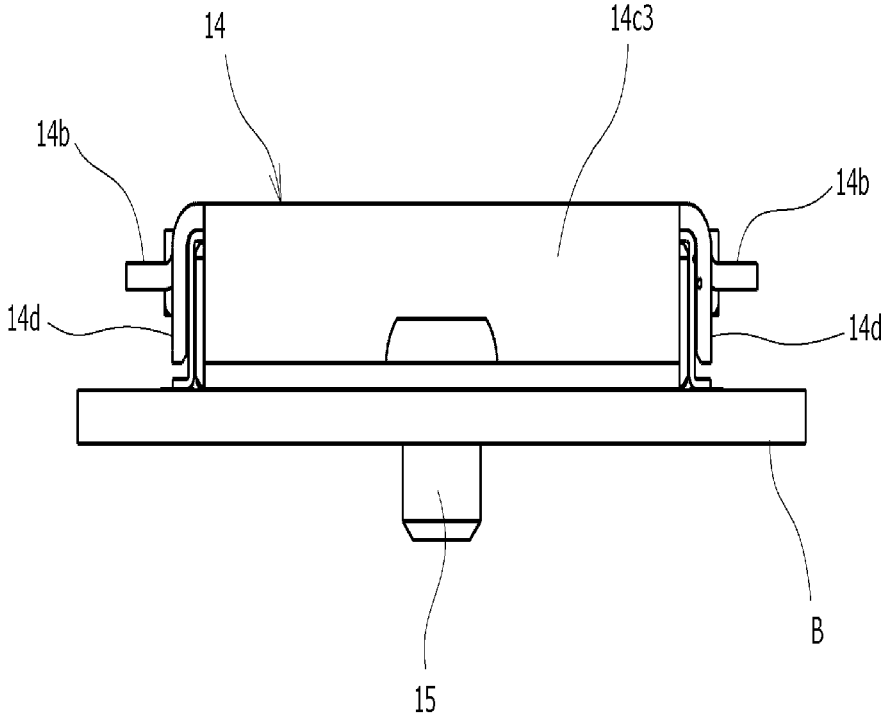
FIG. 6 is an illustrative front view of the electrical connector device with both of the connectors of FIG. 4 being in a fit-in state.

Next, as depicted in FIG. 2 to FIG. 4, a fit-in state of the connectors 1 and 2 with the plug connector (first connector) 1 fitting in the receptacle connector (second connector) 2 is kept by holding power of the fit-in holding member 14 provided to the plug connector 1. When the plug connector 1 fitting in the receptacle connector 2 is removed from the receptacle connector 2, an operation of releasing the fit-in holding member 14 is performed, thereby causing the connectors 1 and 2 to become in a removable state.

Figure 9:
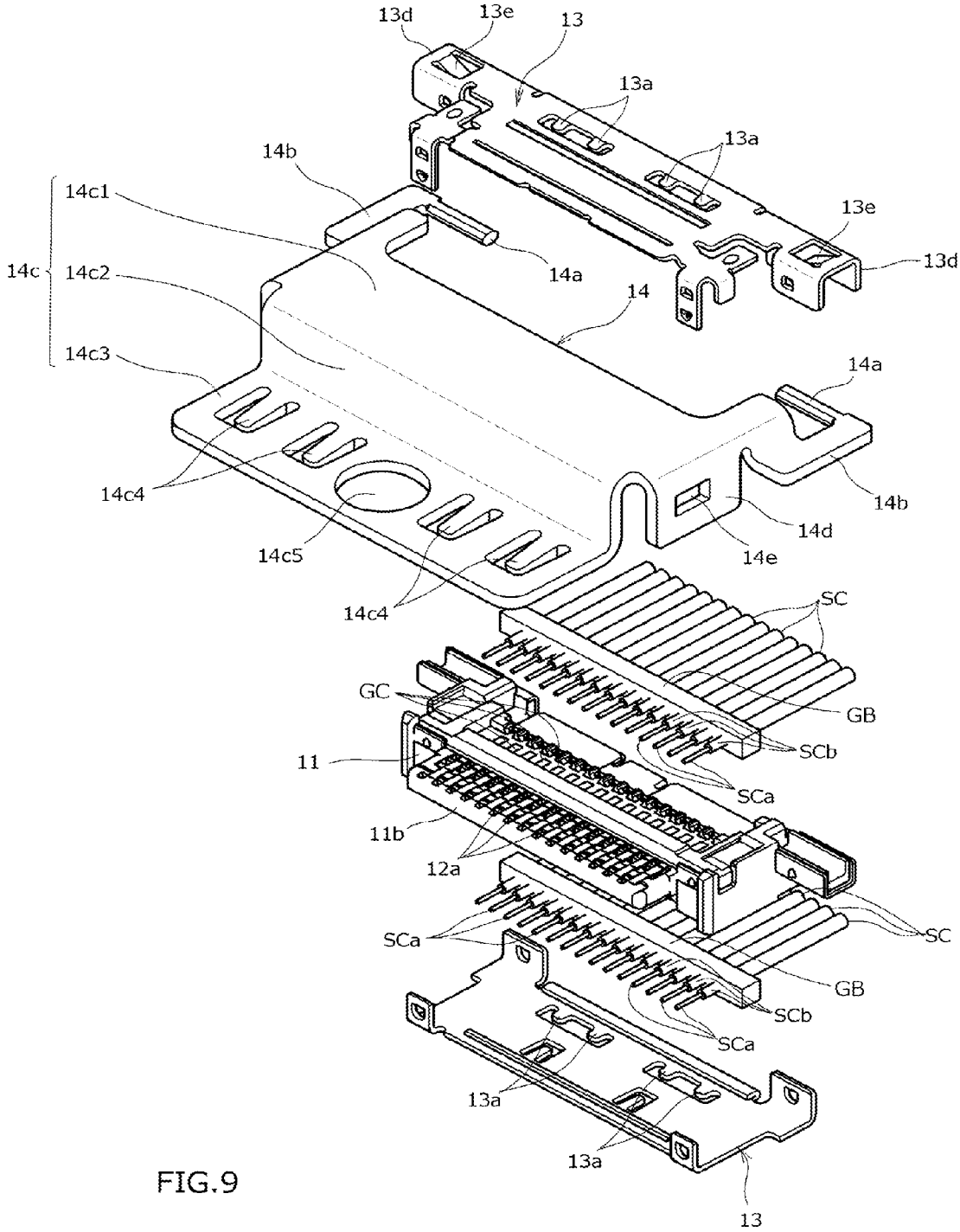
FIG. 9 is an illustrative exploded perspective view of entire structure of the plug connector (first connector) according to the embodiment of the present invention.

More specifically, as depicted in FIG. 9, the fit-in holding member 14 is rotatably mounted on the conductive shell 13 of the plug connector (first connector) 1 described above. Rotating shaft units 14*a* provided at both ends of the fit-in holding member 14 in the connector longitudinal direction are rotatably inserted into paired bearing units 13*d* in a loosely-fitted state, the paired bearing units 13*d* provided at both ends of a rear end portion of the conductive shell 13 in the connector longitudinal direction. The paired rotating shaft units 14*a* provided to the fit-in holding member 14 are each formed so that its cross-sectional surface forms a substantially rectangular shape, and configured so that pressing force of a spring regulating member 13*e* provided to the bearing unit 13*d* is given to any flat surface forming an outer perimeter surface of the rotating shaft unit 14*a*. By that pressing force of the spring regulating member 13*e*, the rotating shaft unit 14*a* is held at a "fit-in release position" or a "fit-in operation position", which will be described further below.

Also, from outer end portions on both sides of the rotating shaft unit 14*a* described above in the connector longitudinal direction, paired coupling arms 14*b* extend approximately along a rotation radius direction. Tip portions, that is, extending end portions, of these coupling arms 14*b* on a rotating side are integrally coupled together by a shield plate 14*c* extending in a plate shape along the connector longitudinal direction. With an operator holding part of the shield plate 14*c* to give appropriate rotating force, the entire fit-in holding member 14 is rotated between the "fit-in release position" depicted in FIG. 1 and FIG. 2 and the "fit-in operation position" depicted in FIG. 3 to FIG. 8.

Figure 7:
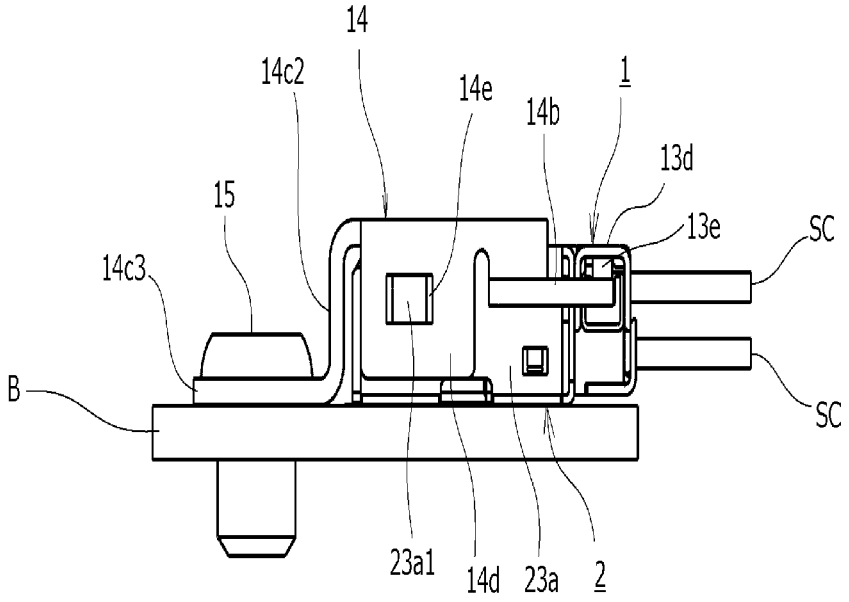
FIG. 7 is an illustrative side view of the electrical connector device with both of the connectors of FIG. 4 being in a fit-in state.
Figure 8:
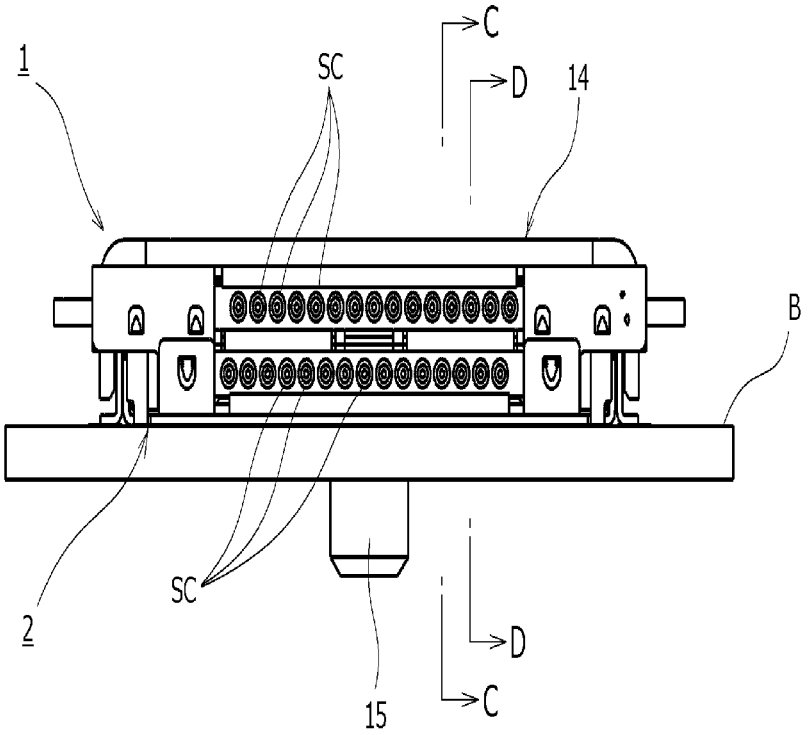
FIG. 8 is an illustrative rear view of the electrical connector device with both of the connectors of FIG. 4 being in a fit-in state.

As depicted in FIG. 3 and FIG. 7, the shield plate 14*c* provided to the fit-in holding member 14 is formed in a shape as being folded so as to form a staircase shape in a side view, and includes an upper-surface shield cover 14*c*1 which covers, from above, the conductive contact members (second contact members) 22 of the receptacle connector (second connector) 2 described above when the fit-in holding member 14 is rotated to the "fit-in operation position". The upper-surface shield cover 14*c*1 extends so as to form a flat plate shape. From an edge of the upper-surface shield cover 14*c*1 on an outward side of the rotation radius, a back-surface shield cover 14*c*2 integrally extends as being folded substantially at the right angle. The back-surface shield cover 14*c*2 extends downward from the edge of the above-described upper-surface shield cover 14*c*1 when the fit-in holding member 14 is rotated to the "fit-in operation position".

Furthermore, at a lower edge of the back-surface shield cover 14*c*2 when the fit-in holding member 14 is rotated to the "fit-in operation position", a ground connection plate 14*c*3 folded substantially at the right angle to extend rearward of the receptacle connector 2 is integrally and consecutively provided. In the following, the structure of each of these components of the shield plate 14*c* is described in detail below.

The upper-surface shield cover 14*c*1 forming part of the fit-in holding member 14 is formed of a flat-plate member extending from tip portions of the above-described coupling arms 14*b* in the rotation radius toward the rear of the receptacle connector (second connector) 2. At both edge portions of the upper-surface shield cover 14*c*1 in the connector longitudinal direction, lock plates 14*d* folded substantially at the right angle to extend downward are integrally and consecutively provided. These lock plates 14*d* are disposed so as to face each other in the connector longitudinal direction, and each of the lock plates 14*d* has a lock engaging hole 14*e* formed so as to penetrate therethrough. When the fit-in holding member 14 is rotated to the "fit-in operation position" as described above, a lock unit provided to the receptacle connector (second connector) 2 is engaged in the lock engaging hole 14*e* formed so as to penetrate through the lock plate 14.

In more detail, each of the hold-down hardware pieces 23*a* provided to the conductive shell 23 of the receptacle connector (second connector) 2 is provided with a lock unit 23*a*1 lightly fitting in the lock engaging hole 14*e* of the fit-in holding member 14 rotated to the "fit-in operation position" described above. The lock unit 23*a*1 is formed of a plate spring member extending outward in the connector longitudinal direction. As described above, when the plug connector 1 fits in the receptacle connector 2 and then the fit-in holding member 14 is rotated to a position near the "fit-in operation position", the lock plates 14*d* provided to the fit-in holding member 14 move to go over the outer extending portions of the lock units 23*a*. Then, the lock units 23*a*1 are elastically displaced so as to fall inside the lock engagement holes 14*e* of the fit-in holding member 14 to establish an engaged state, thereby causing the entire fit-in holding member 14 to be elastically held at the "fit-in operation position".

As such, with the plug connector 1 fitting in the receptacle connector 2, when the fit-in holding member 14 is rotated from the "fit-in release position" to the "fit-in operation position", the both connectors 1 and 2 are held in a fit-in state without being separated by external force in a predetermined range.

Furthermore, as described above, the upper-surface shield cover 14*c*1 forming the shield plate 14*c* of the fit-in holding member 14 is provided so as to extend substantially in a flat plate shape between the portions at the tips of the paired coupling arms 14*b*. As depicted in FIG. 3 and FIG. 4 in particular, when the fit-in holding member 14 is rotated to the "fit-in operation position" when the connectors 1 and 2 fit together, the upper-surface shield cover 14*c*1 has an arrangement relation of covering the conductive contact members (second contact members) 22 of the receptacle connector 2 from above, thereby establishing electromagnetic shielding with respect to a transmission signal. As such, the upper-surface shield cover 14*c*1 is formed in a shape of covering the conductive contact members 22 from above, and the upper-surface shield cover 14*c*1 has a width dimension in the connector longitudinal direction set as slightly longer than a width of multipole arrangement in which the conductive contact members 22 are disposed. With this, the plurality of conductive contact members 22 in multipole arrangement are configured to be entirely covered from above.

Also, as described above, at the rear portion of the conductive contact members (second contact members) 22 provided to the receptacle connector (second connector) 2, the back-surface shield cover 14*c*2 of the fit-in holding member 14 rotated to the "fit-in operation position" is disposed. The back-surface shield cover 14*c*2 as rotated to the "fit-in operation position" is disposed so as to stand upward from the front surface of the printed circuit board B at a position near a tip portion of the board connection legs 22*a* of the conductive contact members 22. As such, with the back-surface shield cover 14*c*2 disposed at the position near the board connection legs 22*a* of the conductive contact members 22 and the board connection legs 22*a* of the conductive contact members 22 shielded from outside by the back-surface shield cover 14*c*2, electromagnetic shielding with respect to the board connection legs 22*a* of the conductive contact members 22 is established.

Furthermore, in the present embodiment, in addition to the upper-surface shield cover 14*c*1 and the back-surface shield cover 14*c*2 forming the shield plate 14*c* of the plug connector (first connector) 1, as described above, the hold-down hardware pieces 23*a* of the conductive shell 23 provided to the receptacle connector (second connector) 2 cover the conductive contact members (second contact members) 22 from both sides in the connector longitudinal direction. That is, the entire conductive contact members 22 are covered with the shield plate 14*c* of the plug connector 1 and the conductive shell 23 of the receptacle connector 2, thereby favorably establishing electromagnetic shielding with respect to the conductive contact members 22.

When the connectors 1 and 2 fit together, the terminal electrode units 12*a* of the conductive contact members (first contact members) 12 and the contact projections 22*b* of the conductive contact members (second contact members) 22 become in a connected state, and their connected portion is covered with the above-described conductive shells 12 and 23 from outside.

Furthermore, the above-described ground connection plate 14*c*3 extending from the lower edge of the back-surface shield cover 14*c*2 forms a "ground connecting unit" in the present invention, is formed so as to be integrally contiguous to the back-surface shield cover 14*c*2 which forms part of the shield plate 14*c*, and is formed of a plate member extending along the front surface of the printed circuit board B when the fit-in holding member 14 is rotated to the "fit-in operation position" as described above.

In the ground connection plate 14*c*3, a plurality of (four) plate spring members 14*c*4 to be in contact with ground connection conductive paths B1 formed on the front surface of the printed circuit board B are formed. These plate spring members 14*c*4 are each formed of an elastic member obtained by cutting part of the above-described ground connection plate 14*c*3 to stand in a cantilever shape, and are disposed so as to be aligned in parallel in the connector longitudinal direction.

On the front surface of the printed circuit board B described above, the plurality of (four) ground connection conductive paths B1 are formed in parallel in the connector longitudinal direction at positions near the rear of the board connection legs 22*a* provided to the conductive contact members (second contact members) 22 of the receptacle connector (second connector) 2. These ground connection conductive paths B1 are provided at positions corresponding to the plate spring members 14*c*4 of the ground connection plate 14*c*3 described above. The ground connection conductive paths B1 are disposed so that the plate spring members 14*c*4 provided to the ground connection plate 14*c*3 elastically make contact with the ground connection conductive paths B1 from above when the fit-in holding member 14 is rotated to the "fit-in operation position" as described above. As such, with the ground connection plate 14*c*3 making contact with the ground connection conductive paths B1 via the plate spring members 14*c*4, a ground circuit is formed.

Also, at a substantially center portion of the ground connection plate 14*c*3 provided to the fit-in holding member 14 as described above in the connector longitudinal direction, a ground fixing hole 14*c*5 for insertion of a fixing screw 15 as mechanical coupling means is formed in the fit-in holding member 14 so as to penetrate therethrough. Also, a board fixing hole B2 is formed in the printed circuit board B to penetrate therethrough and overlap a lower side of the ground fixing hole 14*c*5 provided in the ground connection plate 14*c*3.

After the fit-in holding member 14 is rotated to the "fit-in operation position", the fixing screw (mechanical coupling means) 15 is inserted from above into the ground fixing hole 14*c*5 provided in the ground connection plate 14, and a screw-formed portion of the fixing screw 15 penetrates through the ground connection plate 14*c*3 to be screwed into the board fixing hole B2 in the printed circuit board B for fastening and fixation. With this fastening and fixing operation by screwing of the fixing screw 15, the plate spring members 14*c*4 of the ground connection plate 14*c*3 described above are firmly in contact with the ground connection conductive paths B1, thereby enhancing electrical connectivity.

Here, the fixing screw (mechanical coupling means) 15 in the present embodiment is disposed in a portion between the plate spring members 14*c*4 adjacent in the connector longitudinal direction, thereby causing the fixing operation of the fixing screw 15 described above to be efficiently transferred to the plate spring members 14*c*4 and enhancing contact ability of the plate spring members 14*c*4 with respect to the ground connection conductive paths B1.

According to the embodiment of the present invention with the above-described structure, with the fit-in holding member 14 rotated from the "fit-in release position" to the "fit-in operation position" after the connectors 1 and 2 fit together, the shield plate 14*c* provided to the fit-in holding member 14 externally covers the board connection legs 22*a* of the conductive contact members (second contact members) 22 of the receptacle connector (second connector) 2. Therefore, simultaneously with an operation of rotating the fit-in holding member 14 when the connectors 1 and 2 fit together, electromagnetic shielding with respect to the board connection legs 22*a* is immediately established.

Also, simultaneously with this establishment of electromagnetic shielding, the ground connection plate (ground connecting unit) 14*c*3 provided to the fit-in holding member 14 is connected to the ground connection conductive paths B1 disposed near the board connection legs 22*a* of the conductive contact members (second contact members) 22 of the receptacle connector (second connector) 2. Therefore, a ground connection is made at a position near a portion subjected to electromagnetic shielding, thereby achieving favorable electromagnetic shielding characteristics.

Furthermore, the board connection legs 22*a*, which are portions of the conductive contact members (second contact members) 22 to be connected to the printed circuit board B, are not covered with the ground connection plate (ground connecting unit) 14*c*3 of the fit-in holding member 14. Therefore, the connected state at the board connection legs 22*a* is favorably confirmed.

Still further, in the present embodiment, the ground connection plate 14*c*3 provided to the fit-in holding member 14 is connected to the ground connection conductive paths B1 via the plate spring members 14*c*4, and is fixed via the fixing screw (mechanical coupling means) 15. Therefore, a ground connection for establishing electromagnetic shielding can be reliably and firmly made, thereby further improving electromagnetic shielding characteristics.

While the invention made by the present inventor has been specifically described based on the embodiment, the present invention is not meant to be restricted to the above-described embodiment, and it is needless to say that the present invention can be variously modified without deviating from the gist of the present invention.

For example, while the conductive shell 23 is attached to the receptacle connector (second connector) 2 as a counterpart connector in the above-described embodiment, the present invention can be similarly applied to an electrical connector device including a counterpart connector of a type not having a conductive shell attached thereto.

That is, while the entire conductive contact members 22 are covered with both of the shield plate 14*c* and the conductive shell 23 from outside the printed circuit board B in the above-described embodiment, the entire conductive contact members 22 can be covered with only the shield plate 14*c* from outside the printed circuit board B.

Furthermore, in the above-described embodiment, with the fixing screw 15 as mechanical coupling means inserted into the ground fixing hole 14*c*5 and the screw-formed portion of the fixing screw 15 screwed into the board fixing hole B2 of the printed circuit board B, the ground connection plate 14*c*3 is fastened and fixed. However, the present embodiment is not restricted to this, and any other various mechanical coupling means can be simultaneously adopted.

For example, in place of forming the ground fixing hole 14*c*5 in the ground connection plate 14*c*3, an elastic lock piece integrally extending from the ground connection plate 14*c*3 may be formed at the position where the ground fixing hole 14*c*5 is formed, and may be engaged into the board fixing hole B2 in the printed circuit board B, thereby serving as mechanical coupling means. In this case, engaging power of the lock piece is set stronger than contact pressure of the plate spring members 14*c*4 formed in the ground connection plate 14*c*3 to be given to the ground connection conductive paths B1.

Still further, while the mechanical coupling means in the above-described embodiment is disposed in the portion between the plate spring members 14*c*4, this is not meant to be restrictive, and a plurality of mechanical coupling means may be provided so as to have the plate spring members 14*c*4 interposed therebetween.

Still further, the present invention is not restricted to a coaxial cable connector as in the above-described embodiment, and can be similarly applied to an insulating cable connector, an electrical connector of a type in which a plurality of coaxial cables and insulating cables are mixed, an electrical connector to which a flexible circuit board or the like is coupled, a board-to-board connector for connecting printed boards together, and so forth.

As has been described in the foregoing, the present embodiment can be widely applied to various electrical connectors for use in various electrical devices.

What is claimed is:

1. An electrical connector for use as fitting in a counterpart connector implemented on a front surface of a circuit board, with a terminal portion of a signal transmission medium coupled to a connector main body unit, the electrical connector configured so that a contact member mounted on the connector main body unit is connected to the signal transmission medium, a board connection leg of a counterpart contact member mounted on the counterpart connector is connected to the circuit board, and the contact member makes contact with the counterpart contact member when fitting in the counterpart connector to establish electrical connection, and a fit-in holding member rotatably provided to the connector main body unit is rotated from a fit-in release position to a fit-in operation position when fitting in the counterpart connector to keep a state of the fitting in the counterpart connector, wherein the fit-in holding member is provided with a shield plate which covers at least the board connection leg of the counterpart contact member when the fit-in holding member is rotated to the fit-in operation position, a ground connection conductive path is formed at a predetermined position on the front surface of the circuit board near a portion to be connected with the board connection leg of the counterpart contact member, a ground connecting unit provided to the fit-in holding member makes contact with the ground connection conductive path of the circuit board when the fit-in holding member is rotated to the fit-in operation position, and the ground connecting unit of the fit-in holding member is integrally and contiguously formed on the shield plate.

2. The electrical connector according to claim 1, wherein the ground connecting unit provided to the fit-in holding member is configured to be fixed by mechanical coupling means to the circuit board.

3. The electrical connector according to claim 2, wherein the ground connecting unit includes a plurality of plate spring members which elastically make contact with the ground connection conductive path, and the mechanical coupling means is disposed so as to be interposed between the plurality of plate spring members.

4. The electrical connector according to claim 1, wherein the shield plate is formed so as to cover the counterpart contact member from outside the circuit board, and the shield plate includes an upper-surface shield cover which covers the counterpart contact member from outside and a back-surface cover extending from the upper-surface shield cover so as to cover outside of the board connection leg.

5. The electrical connector according to claim 1, wherein a shield shell member which covers an outer surface of the counterpart connector is attached to the counterpart connector, and the counterpart contact member is covered with the shield shell member and the shield plate from outside of the circuit board.

6. The electrical connector according to claim 1, wherein the counterpart connector is provided with a lock unit which holds the fit-in holding member at the fit-in operation position.

7. An electrical connector device comprising:

a first connector to which a terminal portion of a signal transmission medium is to be coupled; and a second connector in which the first connector fits as the second connector is implemented on a front surface of a circuit board, a first contact member mounted on the first connector being connected to the signal transmission medium, a board connection leg of a second contact member mounted on the second connector being connected to the circuit board, and the first contact member making contact with the second contact member when the first and second connectors fit together to establish electrical connection, and a fit-in holding member rotatably provided to the first connector being rotated from a fit-in release position to a fit-in operation position when fitting in the second connector to keep a state of the fitting in the second connector, wherein the fit-in holding member of the first connector is provided with a shield plate which covers at least a board connection leg of the second contact member when the fit-in holding member is rotated to the fit-in operation position, a ground connection conductive path is formed at a predetermined position on the front surface of the circuit board near a portion to be connected with the board connection leg of the second contact member, a ground connecting unit provided to the fit-in holding member makes contact with the ground connection conductive path of the circuit board when the fit-in holding member is rotated to the fit-in operation position, and the ground connecting unit of the fit-in holding member is integrally and contiguously formed on the shield plate.

8. The electrical connector device according to claim 7, wherein the ground connecting unit provided to the fit-in holding member is configured to be fixed by mechanical coupling means to the circuit board.

9. The electrical connector device according to claim 8, wherein the ground connecting unit includes a plurality of plate spring members which elastically make contact with the ground connection conductive path, and the mechanical coupling means is disposed so as to be interposed between the plurality of plate spring members.

10. The electrical connector device according to claim 7, wherein the shield plate is formed so as to cover the second contact member from outside the circuit board, and the shield plate includes an upper-surface shield cover which covers the second contact member from outside and a back-surface cover extending from the upper-surface shield cover so as to cover outside of the board connection leg.

11. The electrical connector device according to claim 7, wherein a shield shell member which covers an outer surface of the second connector is attached to the second connector, and the second contact member is covered with the shield shell member and the shield plate from outside of the circuit board.

12. The electrical connector device according to claim 7, wherein the second connector is provided with a lock unit which holds the fit-in holding member at the fit-in operation position.

* * * * *